US007748960B1

(12) United States Patent
Marussich et al.

(10) Patent No.: US 7,748,960 B1
(45) Date of Patent: Jul. 6, 2010

(54) HUB TO SHAFT CONNECTION

(75) Inventors: Walter Marussich, Palm Beach Gardens, FL (US); Alex Pinera, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 665 days.

(21) Appl. No.: 11/799,643

(22) Filed: May 2, 2007

Related U.S. Application Data

(60) Provisional application No. 60/797,772, filed on May 4, 2006.

(51) Int. Cl.
*F04D 29/054* (2006.01)

(52) U.S. Cl. ..... 416/244 A; 415/216.1

(58) Field of Classification Search ..... 416/244 A, 416/244 R; 464/182, 184; 403/1, 245, 244, 403/246, 242, 263; 415/216.1
See application file for complete search history.

(56) References Cited

U.S. PATENT DOCUMENTS

| | | | | |
|---|---|---|---|---|
| 2,802,680 | A | | 8/1957 | McVeigh |
| 3,019,039 | A | | 1/1962 | Clavell |
| 3,165,342 | A | | 1/1965 | Anderson |
| 3,656,785 | A | | 4/1972 | Lothar |
| 3,756,738 | A | * | 9/1973 | Lee ..... 416/244 R |
| 4,890,946 | A | * | 1/1990 | von Pragenau ..... 403/13 |
| 4,986,733 | A | | 1/1991 | Fleury et al. |
| 5,022,823 | A | | 6/1991 | Edelmayer |
| 5,882,178 | A | | 3/1999 | Hudson et al. |
| 6,296,441 | B1 | | 10/2001 | Gozdawa |
| 6,481,970 | B2 | | 11/2002 | Mukherjee et al. |
| 6,948,913 | B2 | | 9/2005 | Heyes et al. |
| 7,182,579 | B2 | | 2/2007 | Roso et al. |

* cited by examiner

*Primary Examiner*—Richard Edgar
(74) *Attorney, Agent, or Firm*—John Ryznic

(57) ABSTRACT

A rotary shaft to hub connection, such as that used between a centrifugal compressor or pump and a shaft. The hub includes inner and outer axial extending members that fit within inner and outer annular grooves formed within the rotary shaft so that a tight fit between the shaft and the hub is maintained during high speed rotation. An inwardly extending projection is formed on the outer axial extending member of the hub that forms a tight fit against the shaft.

10 Claims, 2 Drawing Sheets

HUB TO SHAFT CONNECTION

CROSS-REFERENCE TO RELATED APPLICATIONS

This Regular utility patent application claims the benefit to an earlier and Provisional patent application 60/797,772 filed on May 4, 2006 and entitled CENTRIFUGAL IMPELLER TO SHAFT MOUNTS.

BACKGROUND OF THE INVENTION

1. Field of the Invention

The present invention relates to impellers mounted to a rotary shaft, and more specifically to a centrifugal impeller.

2. Description of the Related Art Including Information Disclosed Under 37 CFR 1.97 and 1.98

A centrifugal impeller mount on a rotary shaft of the prior art is shown in FIG. 1. In this prior art arrangement, an interference fit is used to secure the impeller to the shaft by a tight fit. The shaft includes a smaller diameter portion 13 and a larger diameter portion 12. The impeller 14 includes a central hole having a larger diameter portion and a smaller diameter portion that forms a tight interference fit with the shafts, the interference fits occurring at locations 16 and 18 on FIG. 1. As the impeller spins, the fit loosens due to centrifugal forces. For heavily centrifugally loaded impellers, the fit has to be very large. This usually causes assembly and disassembly problems. Also, sometimes the impeller and shaft are of different materials and this too can cause problems with the fit. If the impeller has a higher coefficient of thermal expansion than does the shaft, at high temperatures the impeller will expand more than the shaft, and therefore the fit will loosen even more. When the centrifugal force from rotation is added, the fit will loosen even more. U.S. Pat. No. 6,481,970 B2 issued to Mukherjee et al on Nov. 19, 2002 and entitled COMPRESSOR WHEEL WITH PRESTRESSED HUB AND INTERFERENCE FIT INSERT is one prior art reference that shows this design.

It is therefore an object of the present invention to provide for an impeller mounted to a rotatable shaft with a fit that will not loosen during rotation.

It is another object of the present invention to provide for an impeller that can be mounted to the rotatable shaft without pre-stress such that the impeller can more easily be inserted onto the shaft.

BRIEF SUMMARY OF THE INVENTION

The present invention is an inverted fit between the impeller and the shaft in order to use the centrifugal forces to promote a tight fit between the two. As the impeller spins faster, the fit tightens instead of loosening as in the prior art fit. The inverted fit of the present invention is also good for impellers and shafts that have different materials with different coefficients of thermal expansion.

DETAILED DESCRIPTION OF THE INVENTION

Figure 1:
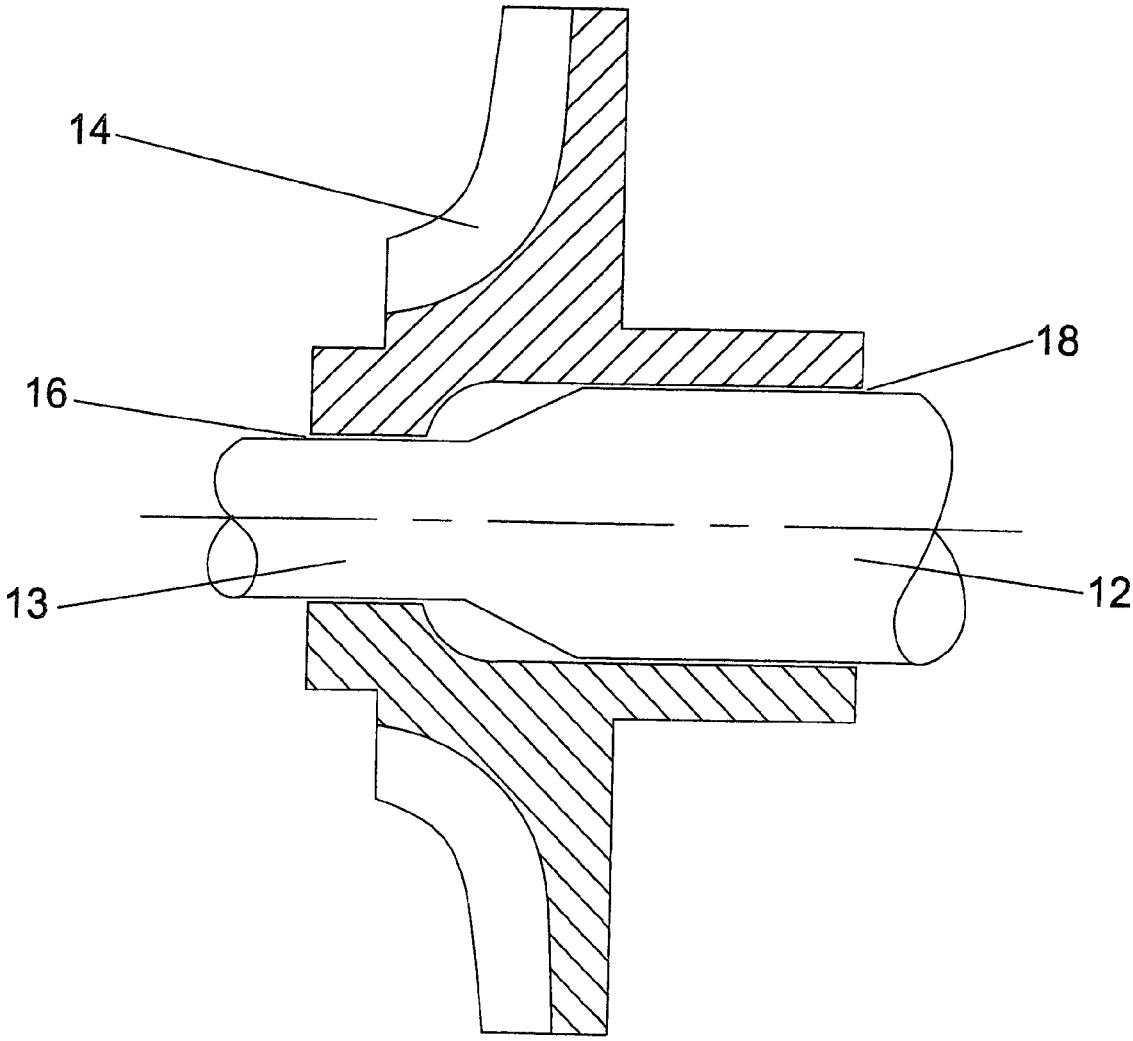
Fig 1 Prior Art
FIG. 1 shows a prior art arrangement of a tight fit between an impeller and a rotary shaft.
Figure 2:
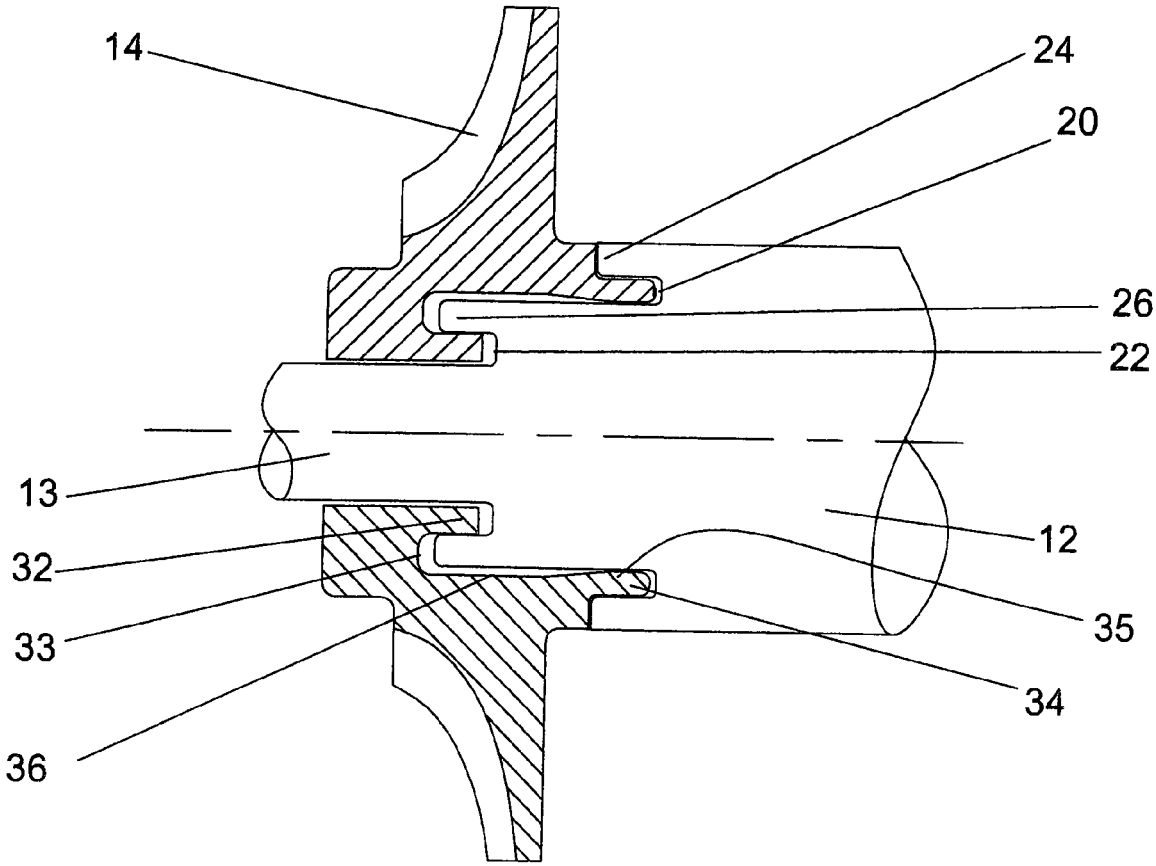
FIG. 2 shows the present invention with the inventive inverted fit between the impeller and the shaft.

The present invention is shown in FIG. 2 in which an impeller 14 of a centrifugal pump or compressor is tightly fitted to a shaft 12. The shaft includes a larger diameter portion 12 and a smaller diameter portion 13. An inner annular groove 22 and an outer annular groove 20 is formed in the shaft, with axial extending portions 26 and 24 defined by the annular grooves 22 and 20. this forms an inner axial extending portion 26 and an outer axial extending portion 24 on the shaft.

The impeller 14 includes an inner axial extending member 32 and an outer axial extending member 34 that define an annular groove 33 formed within the hub of the impeller. The axial extending members 32 and 34 of the impeller are sized and shaped to fit within the annular grooves 20 and 22 of the shaft. The fits are intended to be as tight as possible in order to provide a tight and secure fit between the impeller and the shaft, and to be loose enough to allow the impeller to be fitted onto the shaft during assembly or disassembly. An inwardly facing projection 35 of the impeller extends radially inward more than the section 36 in order to allow for the impeller to more easily slide onto the shaft. The inwardly extending projection 35 will form a tight fit against the shaft on which it abuts. The inward projection 35 is shown to be formed on the hub instead of the shaft because this method would be easier to manufacture than would placing a projection on the shaft. However, the projection could also be on the shaft instead of the hub.

As the impeller and shaft rotate together, the impeller will grow in the radial direction due to centrifugal forces acting thereon. The two axial extending members of the impeller will still abut against the axial extending portions 26 and 24 of the shaft to maintain a tight fit between the impeller and the shaft. Also, if the impeller is formed from a material that has a higher coefficient of thermal expansion than does the shaft, the inverted fit of the present invention will also maintain a tight fit under high temperatures.

We claim the following:

1. A rotatable hub to shaft connection comprising:

a hub having an inner axial extending member and an outer axial extending member forming an annular groove within the hub, the outer axial extending member being radially outward of the inner axial member;

a shaft having an inner annular groove and an outer annular groove forming an inner axial extending portion, the outer annular groove being radially outward of the inner annular groove;

the inner axial extending portion of the shaft fitting into the annular groove of the hub, the inner axial extending member of the hub fitting into the inner annular groove of the shaft, and the outer axial extending member of the hub fitting into the outer annular groove of the shaft such that a tight fit between the hub and shaft will not loosen during rotation; and axial extending members of the hub and the annular grooves of the shaft producing a tight fit due to centrifugal forces acting from rotation of the hub.

2. The rotatable hub to shaft connection of claim 1, and further comprising:

the outer axial extending member of the hub includes an inward extending projection that contacts the shaft to form a tight fit.

3. The rotatable hub to shaft connection of claim 2, and further comprising:

the inward extending projection is near the end of the outer axial extending member of the hub.

4. The rotatable hub to shaft connection of claim 1, and further comprising:

an outer axial extending portion forms the outer annular groove on the shaft.

5. The rotatable hub to shaft connection of claim 4, and further comprising:

the outer axial extending portion of the shaft forms the outer diameter of the shaft.

6. The rotatable hub to shaft connection of claim 4, and further comprising:

the inner and the outer axial extending members of the hub abut against the inner and the outer axial extending portions of the shaft during rotation to maintain a tight fit between the hub and the shaft.

7. The rotatable hub to shaft connection of claim 1, and further comprising:

the inner axial extending member of the hub and the inner axial extending portion of the shaft are in contact during rotation and during rest of the shaft and hub.

8. The rotatable hub to shaft connection of claim 1, and further comprising:

the hub supports a centrifugal compressor.

9. The rotatable hub to shaft connection of claim 8, and further comprising:

the hub is formed from a material that has a higher coefficient of thermal expansion than does the shaft.

10. The rotatable hub to shaft connection of claim 1, and further comprising:

the hub includes a central opening; and, the shaft includes a smaller diameter portion that extends through the central opening of the hub.

* * * * *

UNITED STATES PATENT AND TRADEMARK OFFICE

CERTIFICATE OF CORRECTION

PATENT NO. : 7,748,960 B1
APPLICATION NO. : 11/799643
DATED : July 6, 2010
INVENTOR(S) : Walter Marussich et al.

It is certified that error appears in the above-identified patent and that said Letters Patent is hereby corrected as shown below:

Col. 1, line 3, please insert the following:

--GOVERNMENT LICENSE RIGHTS
[0002.1] This invention was made with Government support under contract number FA9300-04-C-0008 awarded by the US Air Force. The Government has certain rights in the invention.--

Signed and Sealed this
Seventeenth Day of July, 2012

David J. Kappos
*Director of the United States Patent and Trademark Office*